US006981546B2

(12) United States Patent
Hall et al.

(10) Patent No.: US 6,981,546 B2
(45) Date of Patent: Jan. 3, 2006

(54) ELECTRICAL TRANSMISSION LINE DIAMETRICAL RETENTION MECHANISM

(75) Inventors: David R. Hall, Provo, UT (US); H. Tracy Hall, Jr., Provo, UT (US); David Pixton, Lehi, UT (US); Scott Dahlgren, Provo, UT (US); Cameron Sneddon, Provo, UT (US); Michael Briscoe, Lehi, UT (US); Joe Fox, Spanish Fork, UT (US)

(73) Assignee: IntelliServ, Inc., Provo, UT (US)

( * ) Notice: Subject to any disclaimer, the term of this patent is extended or adjusted under 35 U.S.C. 154(b) by 216 days.

(21) Appl. No.: 10/456,104

(22) Filed: Jun. 9, 2003

(65) Prior Publication Data

US 2004/0244964 A1 Dec. 9, 2004

(51) Int. Cl.
*H01R 4/64* (2006.01)

(52) U.S. Cl. ..... 166/65.1; 439/194

(58) Field of Classification Search ..... 166/65.1, 166/241.5, 242.1, 242.3, 242.6; 138/111, 138/114–117, 178; 439/194; 340/853.1
See application file for complete search history.

(56) References Cited

U.S. PATENT DOCUMENTS

| | | | |
|---|---|---|---|
| 749,633 | A | 1/1904 | Seeley |
| 2,178,931 | A | 11/1939 | Crites et al. |
| 2,197,392 | A | 4/1940 | Hawthorn |
| 2,249,769 | A | 7/1941 | Leonardon |
| 2,301,783 | A | 11/1942 | Lee |
| 2,354,887 | A | 8/1944 | Silverman et al. |
| 2,379,800 | A | 7/1945 | Hare |
| 2,414,719 | A | 1/1947 | Cloud |
| 2,531,120 | A | 11/1950 | Feaster |
| 2,633,414 | A | 3/1953 | Boivinet |
| 2,659,773 | A | 11/1953 | Barney |
| 2,662,123 | A | 12/1953 | Koenig, Jr. |
| 2,748,358 | A | 5/1956 | Johnston |
| 2,974,303 | A | 3/1961 | Dixon |
| 2,982,360 | A | 5/1961 | Morton et al. |
| 3,079,549 | A | 2/1963 | Martin |
| 3,090,031 | A | 5/1963 | Lord |
| 3,170,137 | A | 2/1965 | Brandt |
| 3,186,222 | A | 6/1965 | Martin |
| 3,194,886 | A | 7/1965 | Mason |
| 3,209,323 | A | 9/1965 | Grossman, Jr. |
| 3,227,973 | A | 1/1966 | Gray |
| 3,253,245 | A | 5/1966 | Brandt |
| 3,518,608 | A | 6/1970 | Papadopoulos |

(Continued)

FOREIGN PATENT DOCUMENTS

| | | |
|---|---|---|
| EP | 0399987 A1 | 11/1990 |
| WO | WO8801096 | 2/1988 |
| WO | WO9014497 | 11/1990 |
| WO | WO02/06716 A1 | 1/2002 |

*Primary Examiner*—Kenneth Thompson
(74) *Attorney, Agent, or Firm*—Jeffery R. Daly; Cameron R. Sneddon

(57) ABSTRACT

The invention is a mechanism for retaining an electrical transmission line. In one embodiment of the invention it is a system for retaining an electrical transmission line within downhole components. The invention allows a transmission line to be attached to the internal diameter of drilling components that have a substantially uniform drilling diameter. In accordance with one aspect of the invention, the system includes a plurality of downhole components, such as sections of pipe in a drill string, drill collars, heavy weight drill pipe, and jars. The system also includes a coaxial cable running between the first and second end of a drill pipe, the coaxial cable having a conductive tube and a conductive core within it. The invention allows the electrical transmission line to withstand the tension and compression of drill pipe during routine drilling cycles.

22 Claims, 7 Drawing Sheets

U.S. PATENT DOCUMENTS 3,696,332 A 10/1972 Dickson, Jr. et al.
3,793,632 A 2/1974 Still
3,807,502 A 4/1974 Heilhecker et al.
3,879,097 A 4/1975 Oertle
3,930,220 A 12/1975 Shawhan
3,957,118 A 5/1976 Barry et al.
3,989,330 A 11/1976 Cullen et al.
4,012,092 A 3/1977 Godbey
4,087,781 A 5/1978 Grossi et al.
4,095,865 A 6/1978 Denison et al.
4,121,193 A 10/1978 Denison
4,126,848 A 11/1978 Denison
4,215,426 A 7/1980 Klatt
4,220,381 A 9/1980 Van der Graaf
4,348,672 A 9/1982 Givler
4,445,734 A 5/1984 Cunningham
4,496,203 A 1/1985 Meadows
4,537,457 A 8/1985 Davis, Jr. et al.
4,578,675 A 3/1986 MacLeod
4,605,268 A 8/1986 Meador
4,660,910 A 4/1987 Sharp et al.
4,683,944 A 8/1987 Curlett
4,698,631 A 10/1987 Kelly, Jr. et al.
4,722,402 A 2/1988 Weldon
4,785,247 A 11/1988 Meador et al.
4,788,544 A 11/1988 Howard
4,806,115 A * 2/1989 Chevalier et al. ..... 439/194
4,806,928 A 2/1989 Veneruso
4,884,071 A 11/1989 Howard
4,901,069 A 2/1990 Veneruso
4,914,433 A 4/1990 Galle
4,924,949 A 5/1990 Curlett
4,971,147 A * 11/1990 Thomeer ..... 166/65.1
5,008,664 A 4/1991 More et al.
5,052,941 A 10/1991 Hernandez-Marti et al.
5,148,408 A 9/1992 Matthews
5,248,857 A 9/1993 Ollivier
5,255,739 A * 10/1993 Neuroth et al. ..... 166/65.1
5,278,550 A 1/1994 Rhein-Knudsen et al.
5,302,138 A 4/1994 Shields
5,311,661 A 5/1994 Zifferer
5,332,049 A 7/1994 Tew
5,334,801 A 8/1994 Mohn
5,371,496 A 12/1994 Tanamachi
5,454,605 A 10/1995 Mott
5,455,573 A 10/1995 Delatorre
5,505,502 A 4/1996 Smith et al.
5,517,843 A 5/1996 Winship
5,521,592 A 5/1996 Veneruso
5,568,448 A 10/1996 Tanigushi et al.
5,650,983 A 7/1997 Kondo et al.
5,691,712 A 11/1997 Meek et al.
5,743,301 A 4/1998 Winship
RE35,790 E 5/1998 Pustanyk et al.
5,810,401 A 9/1998 Mosing et al.
5,833,490 A 11/1998 Bouldin
5,853,199 A 12/1998 Wilson
5,856,710 A 1/1999 Baughman et al.
5,898,408 A 4/1999 Du
5,908,212 A 6/1999 Smith et al.
5,924,499 A 7/1999 Birchak et al.
5,942,990 A 8/1999 Smith et al.
5,955,966 A 9/1999 Jeffryes et al.
5,959,547 A 9/1999 Tubel et al.
5,971,072 A 10/1999 Huber et al.
6,030,004 A 2/2000 Schnock et al.
6,041,872 A 3/2000 Holcomb
6,045,165 A 4/2000 Sugino et al.
6,046,685 A 4/2000 Tubel
6,057,784 A 5/2000 Schaaf et al.
6,104,707 A 8/2000 Abraham
6,108,268 A 8/2000 Moss
6,123,561 A 9/2000 Turner et al.
6,141,763 A 10/2000 Smith et al.
6,173,334 B1 1/2001 Matsuzaki et al.
6,177,882 B1 1/2001 Ringgenberg et al.
6,188,223 B1 2/2001 van Steenwyk et al.
6,196,335 B1 3/2001 Rodney
6,209,632 B1 4/2001 Holbert et al.
6,220,362 B1 * 4/2001 Roth et al. ..... 166/380
6,223,826 B1 5/2001 Chau et al.
6,367,565 B1 4/2002 Hall
6,392,317 B1 5/2002 Hall et al.
6,405,795 B2 6/2002 Holbert et al.
6,641,434 B2 11/2003 Boyle et al.
6,655,464 B2 12/2003 Chau et al.
6,670,880 B1 12/2003 Hall et al.
6,717,501 B2 4/2004 Hall et al.
2002/0135179 A1 9/2002 Boyle et al.
2002/0193004 A1 12/2002 Boyle et al.
2003/0070842 A1 4/2003 Bailey et al.
2003/0213598 A1 11/2003 Hughes

* cited by examiner

ELECTRICAL TRANSMISSION LINE DIAMETRICAL RETENTION MECHANISM

FEDERAL SPONSORSHIP

This invention was made with government support under Contract No. DE-FC26-01NT41229 awarded by the U.S. Department of Energy. The government has certain rights in the invention.

BACKGROUND

The present invention relates to the field of retention mechanisms of electrical transmission lines, particularly retention mechanisms for coaxial cables. The preferred mechanisms are particularly well suited for use in difficult environments wherein it is desirable to retain a transmission line without the normal means available such as brackets, screws and such. One such application is in data transmission systems for downhole environments, such as along a drill string used in oil and gas exploration or along the casings and other equipment used in oil and gas production.

The goal of accessing data from a drill string has been expressed for more than half a century. As exploration and drilling technology has improved, this goal has become more important in the industry for successful oil gas, and geothermal well exploration and production. For example, to take advantage, of the several advances in the design of various tools and techniques for oil and gas exploration, it would be beneficial to have real time data such as temperature, pressure, inclination, salinity, etc. Several attempts have beau made to devise a successful system for accessing such drill string data. One such system is disclosed In co-pending U.S. Application Ser. No. 09/909,469 (also published as PCT Application WO 02/06716), now U.S. Pat. No. 6,717,501. which is assigned to the same assignee as the present invention. The disclosure of this U.S. Application Ser. No. 09/909,469, now U.S. Pat. No. 6,717,501, is incorporated herein by reference, Another such system is disclosed in co-pending U.S. application Ser. No. 10/358,099 the title of which is DATA TRANSMISSION SYSTEM FOR A DOWNHOLE COMPONENT filed on Feb. 3, 2003. The disclosure of this U.S. Application Ser. No. 10/358,099; now U.S. Patent Publication No. US20040149471A1, is herein incorporated by reference.

SUMMARY

Briefly stated, the invention is a system for retaining an electrical transmission line through a string of downhole components.

In accordance with one aspect of the invention, the system includes a plurality of downhole components, such as sections of pipe in a drill string. Each component has a first and second end, with a first communication element located at the first end and a second communication element located at the second end. Each communication element includes a first contact and a second contact. The system also includes a coaxial cable running between the first and second communication elements, the coaxial cable having a conductive tube and a conductive core within it. The system also includes a first and second connector for connecting the first and second communication elements respectively to the coaxial cable. Each connector includes a conductive sleeve, lying concentrically within the conductive tube, which fits around and makes electrical contact with the conductive core. The conductive sleeve is electrically isolated from the conductive tube. The conductive sleeve of the first connector is in electrical contact with the first contact of the first communication element, the conductive sleeve of the second connector is in electrical contact with the first contact of the second communication element, and the conductive tube is in electrical contact with both the second contact of the first communication element and the second contact of the second communication element.

In accordance with another aspect of the invention, the drill components are sections of drill pipe, each having a central bore, and the first and second communication elements are located in a first and second recess respectively at each end of the drill pipe. The system further includes a first passage passing between the first recess and the central bore and a second passage passing between the second recess and the central bore. The first and second connectors are located in the first and second passages respectively. Preferably, each section of drill pipe has a portion with an increased wall thickness at both the box end and the pin end with a resultant smaller diameter of the central bore at the box end and pin end, and the first and second passages run through the portions with an increased wall thickness and generally parallel to the longitudinal axis of the drill pipe. The box end and pin end is also sometimes referred to as the box end tool joint and pin end tool joint.

In accordance with another aspect of the invention, the components are sections of drill pipe, drill collars, jars, and similar components that would be typically found in a drill string. This invention is particularly useful when such drill components have a substantially uniform internal diameter. A through passage in the increased wall of a pin end and box end tool joint as described above is not always possible with different size pipes and other types of drill components. Another retention mechanism other than that described above must be employed. One such retention mechanism is overlapping slots which are particularly useful to affix the coaxial cable to the inside wall of the pipe. The overlapping slots replace the need for a passageway connecting the first and second recess to the central bore or internal diameter of the drill component. A system of overlapping slots is placed near each box end and pin end tool joint.

In accordance with another aspect of the invention, the system includes a first and second expansion plug, each of which includes a central passage and each of which is press-fit within the conductive tube so as to maintain the increased outside diameter of the conductive tube within the larger diameter portions of the first and second passages respectively. The system also preferably includes a first and second retaining plug, each of which includes ridges on its outer surface to retain the expansion plugs in place.

The expansion plugs could alternatively be internal diametrical expansion mandrels with a central passage, the expansion mandrel having a front and back end. The back end of the expansion mandrel has an outer diameter that is greater than an outer diameter of the front end of the expansion mandrel. The retention plugs could alternatively be expansion mandrels with the back end having external circumferentially grooved barbs, also known as a barbed expansion mandrel, that dig into the conductive tube internal diameter. These expansion mandrels become electrical transmission line retainers when displaced within an electrical transmission line. The central passage of the expansion mandrels or retainers could also be electrically insulated allowing bare wire to pass through without causing an electrical short.

In accordance with another aspect of the invention, the method includes expanding the outside diameter of the conductive tube by inserting an expansion plug or mandrel into each end. The first and second communication elements each include an inductive coil having at least one loop of wire. In each communication element, a first end of the wire is in electrical contact with the conductive tube and a second end of the wire is in electrical contact with the conductive sleeve. The method further includes inserting a water-tight seal between the second end of the wire and the inside of the conductive tube.

In accordance with another aspect of the invention, the method includes affixing the conductive tube to the inside diameter of the drill component. After the above mentioned expansion mandrel is inserted into the conductive tube, the conductive tube is then inserted in one end of the overlapping slots in the drill component and stretched far enough to place the other end of the conductive tube in the opposite end of the drill component.

The present invention, together with attendant objects and advantages, will be best understood with reference to the detailed description below in connection with the attached drawings.

DETAILED DESCRIPTION OF THE PRESENTLY PREFERRED EMBODIMENTS

It should be noted that, as used herein, the term "downhole" is intended to have a relatively broad meaning, including such environments as drilling in oil and gas, gas and geothermal exploration, the systems of casings and other equipment used in oil, gas and geothermal production.

It should also be noted that the term "transmission" as used in connection with the phrase data transmission or the like, is intended to have a relatively broad meaning, referring to the passage of signals in at least one direction from one point to another.

Figure 1:
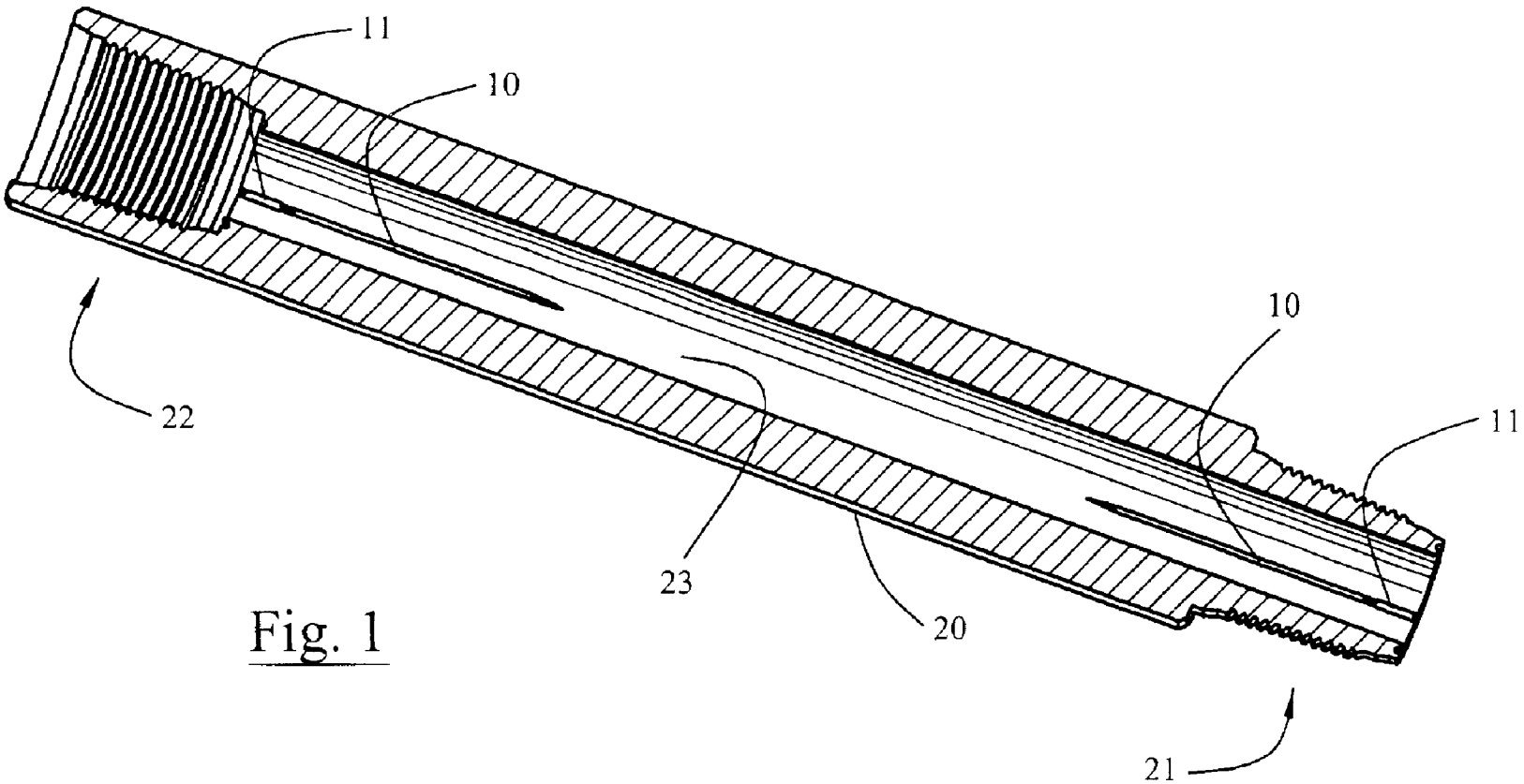
FIG. 1 is cross-sectional view of a drill component exhibiting the overlapping slots.

Referring to the drawings, FIG. 1 is a cross-sectional view of a drill component exhibiting the overlapping slots of the present invention. The most preferred application of the retention mechanism is in the data transmission system in sections of drill pipe, which make up a drill string used in oil and gas or geothermal exploration.

The depicted section 20 of FIG. 1 includes a pin end 21 and a box end 22. Between the pin end 21 and box end 22 is the body of the section. A typical length of the body is between 30 and 90 feet. Drill strings in oil and gas production can extend as long as 20,000 feet, which means that as many as 700 sections of drill pipe and downhole tools can be used in the drill string.

There are several designs for the pin and box end of drill pipe. This invention is particularly useful for pin and box end designs that have a uniform diameter with the rest of the pipe component. Pipe component 20 has a uniform central bore or internal diameter 23. Smaller pipe sizes and many other drilling components such as drill collars, heavy weight drill pipe, and jars may have a uniform internal diameter depending on the size of drill pipe used. FIG. 1 also includes the overlapping slots made of a first slot 10 and a second slot 11. The first slot 10 is smaller than the second slot 11.

Figure 2:
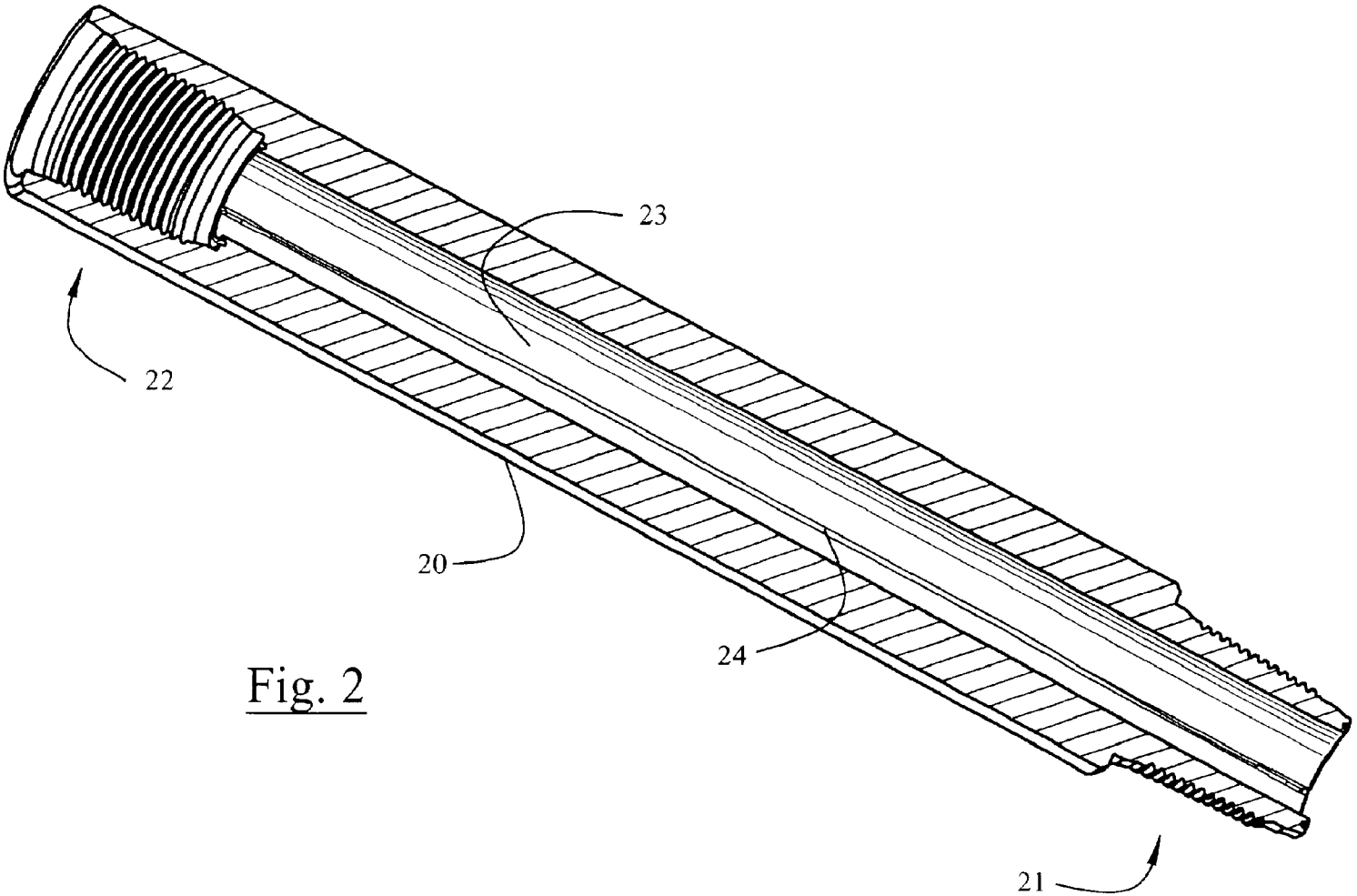
FIG. 2 is a cross-sectional view of a drill component showing the electrical transmission line in place.

As shown in FIG. 2, an electrical transmission line or coaxial cable, of which conductive tube 24 is shown, can be placed within the internal diameter or central bore 23 of pipe component 20. The electrical transmission line can be a coaxial cable including a conductive tube and conductive core with in it. Each end of the coaxial cable is placed near the end of each box end 22 and pin end 21.

Figure 3:
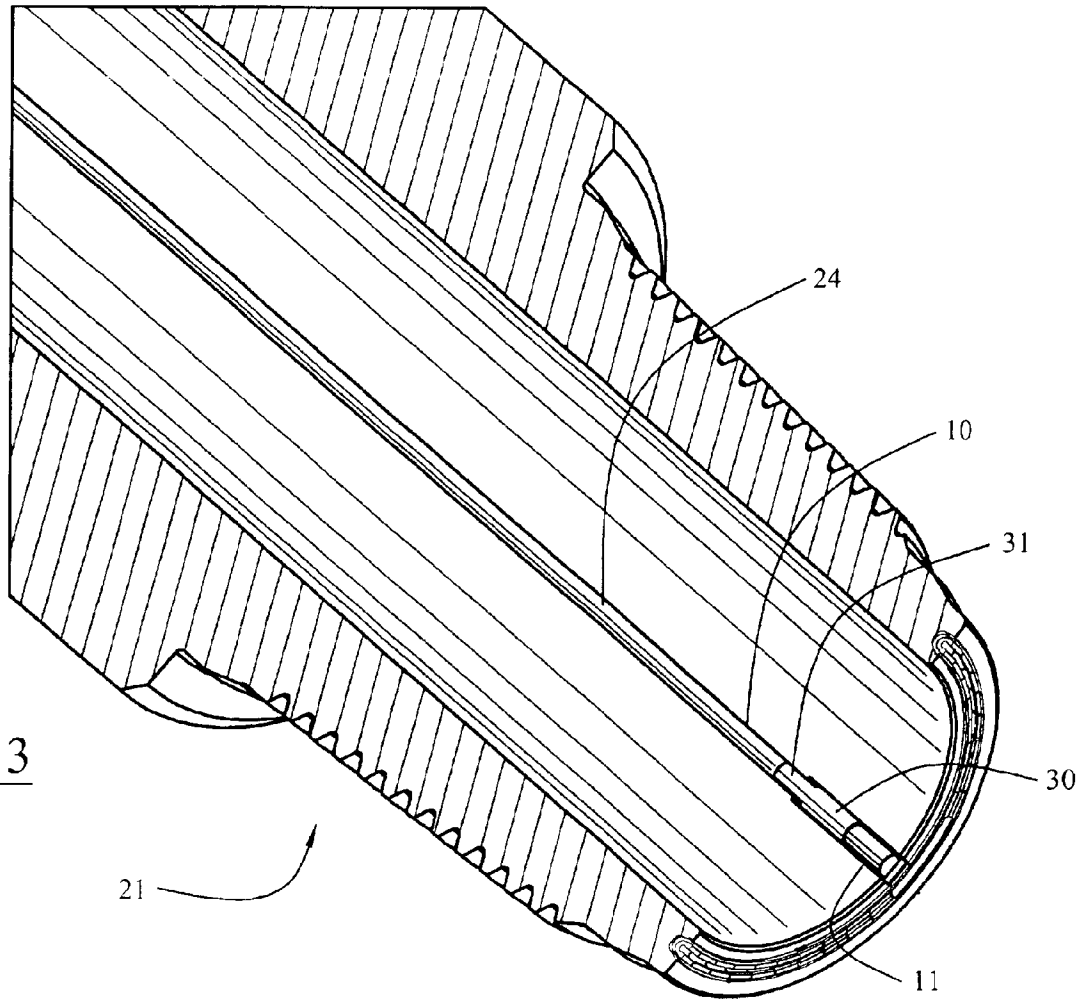
FIG. 3 is an enlarged cross sectional view or the pin end of a drill component as depicted in FIG. 1.

FIG. 3 is a more detailed close up of the coaxial cable in the pin end 21, of which the conductive tube 24 is shown. The coaxial cable, of which the conductive tube 24 is shown, will have a first outer diameter 31 and a second outer diameter 30 which is larger than the first outer diameter 31. The first slot 10 is smaller than the slot 11. Slots 10 and 11 are made to overlap which are depicted more clearly in the other figures. The outer diameter 31 is smaller than the second slot 11. The second slot 11 is at least as wide as the second outer diameter 30.

Figure 4:
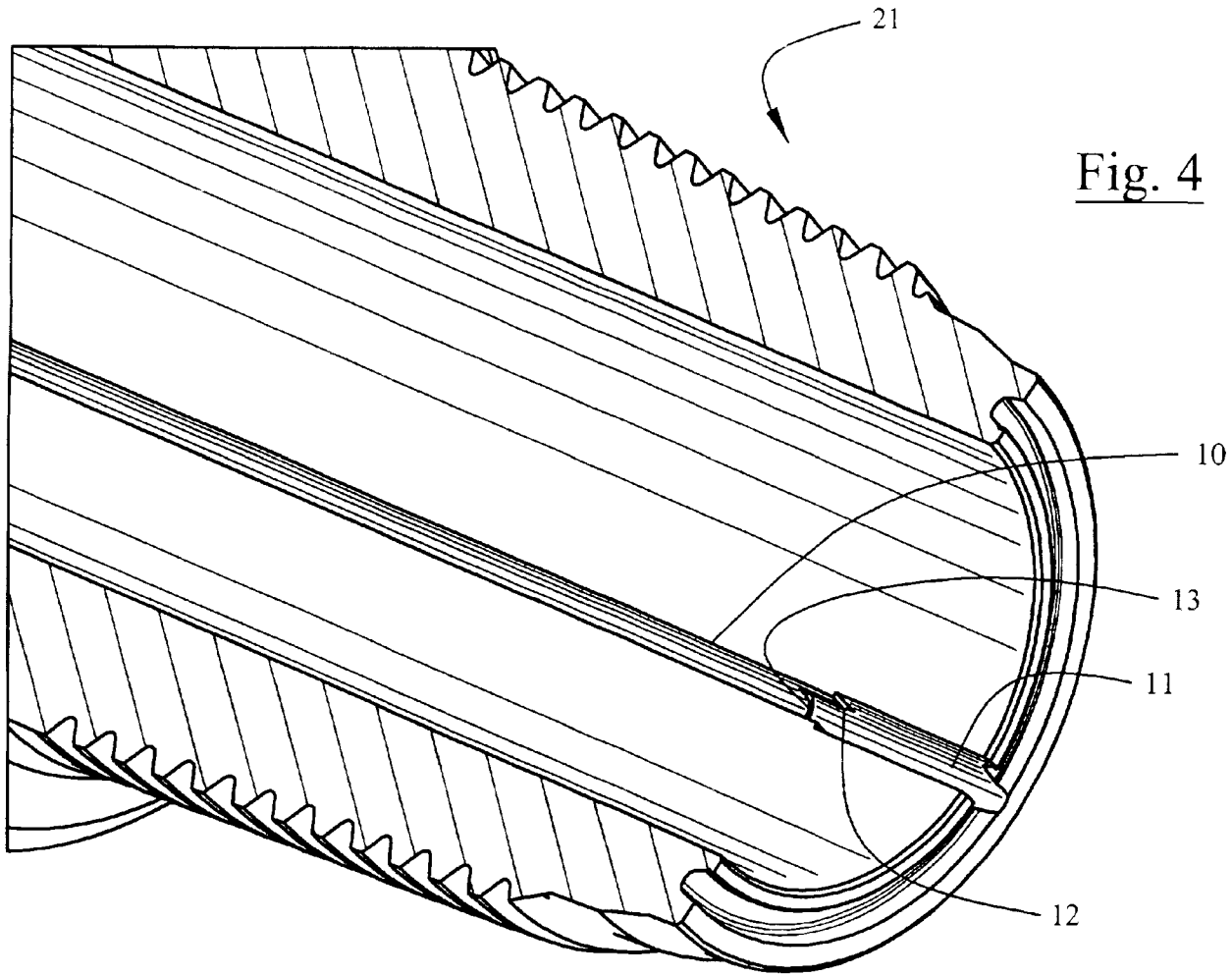
FIG. 4 is an enlarged cross-sectional view showing the pin end of FIG. 1 and the shoulder.

As shown in FIG. 4 we see a cross-sectional view of the pin end 21 form drill component 20 as depicted in FIG. 1. Without the electrical transmission line or coaxial cable, of which conductive tube 24 is shown, in place, it is easier to see how the overlapping slots work. The first slot 10 intersects the second slot 11 such that an overlap of the slots occurs. The smaller width of slot 10 over laps the larger slot 11 such that an undercut 12 and shoulder 13 are created. The larger slot 11 is placed underneath the smaller slot 10 at the intersection of the two slots where the overlap exists. Slots 10 and 11 are formed such that both slots and the undercut 12 and shoulder 13 form complimentary recesses to the first and second outer diameters 30 and 31 of conductive tube 24 as depicted in FIG. 3. In still another embodiment of the invention, the conductive tube 24 could be press fit into the complimentary recesses formed by the overlapping slots 10 and 11. Furthermore the slots do not necessarily have to line up with each other; the slots could be offset by a desired amount depending on the type of electrical conductor being employed.

Figure 5:
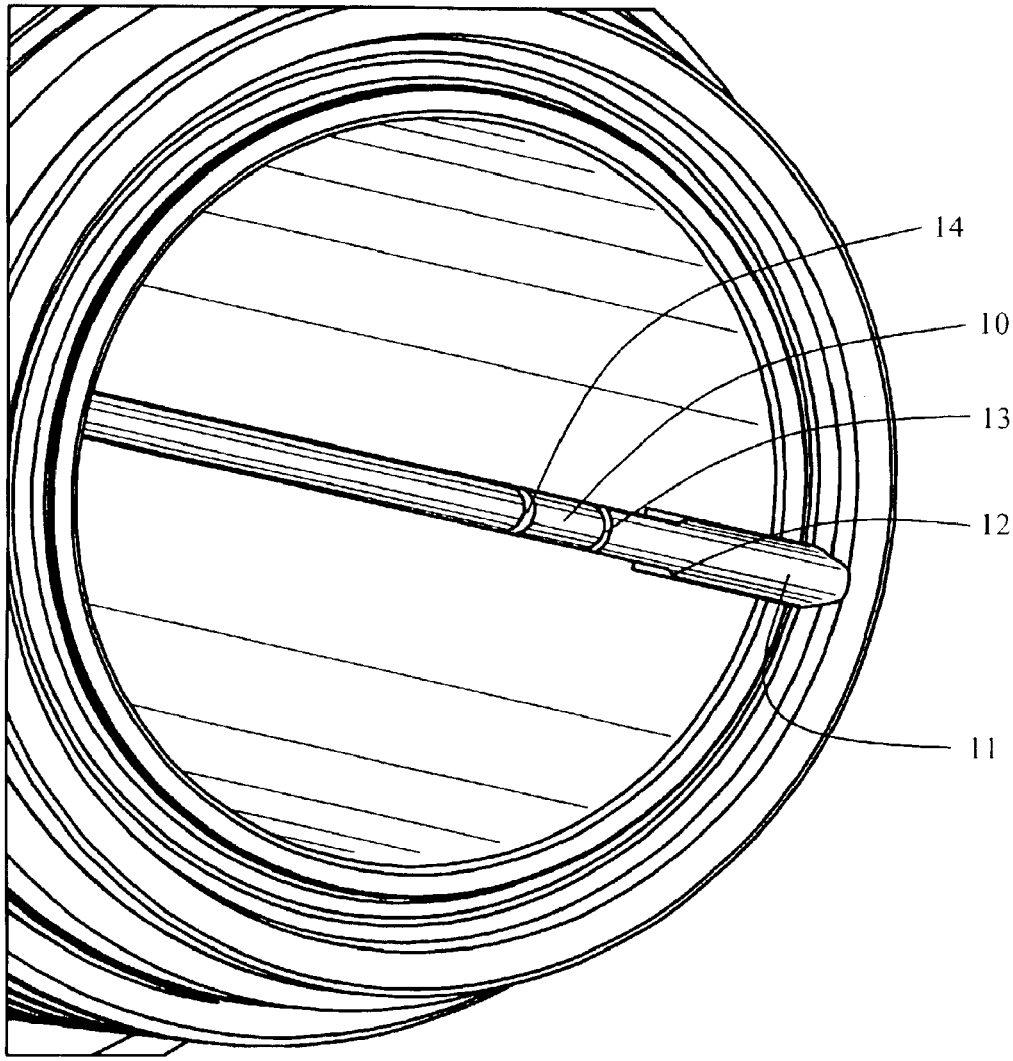
FIG. 5 is an enlarged view of the pin end of a drill component as depicted in FIG. 1 showing more than one slot.

In another embodiment of the invention, more than two slots can be used. The invention can also include more than two shoulders as depicted in FIG. 5 which is an enlarged view of the pin end 21 of drill component 20 as shown in FIG. 1. A first slot 10 and second slot 11 forms the undercut 12 and shoulder 13. Another shoulder 14 is placed beyond slot 10. This can be created by having third slot placed below slot 10. Indeed, a plurality of slots can be implemented to increase the retention strength depending on the application as needed. Each subsequent slot should have an increasing width. Corresponding changes in the outer diameter of the conductive tube 24 would also need to be made such that the plurality of slots will form shoulders and undercuts that form complimentary recesses with each corresponding outer diameter of the conductive tube.

Figure 6:
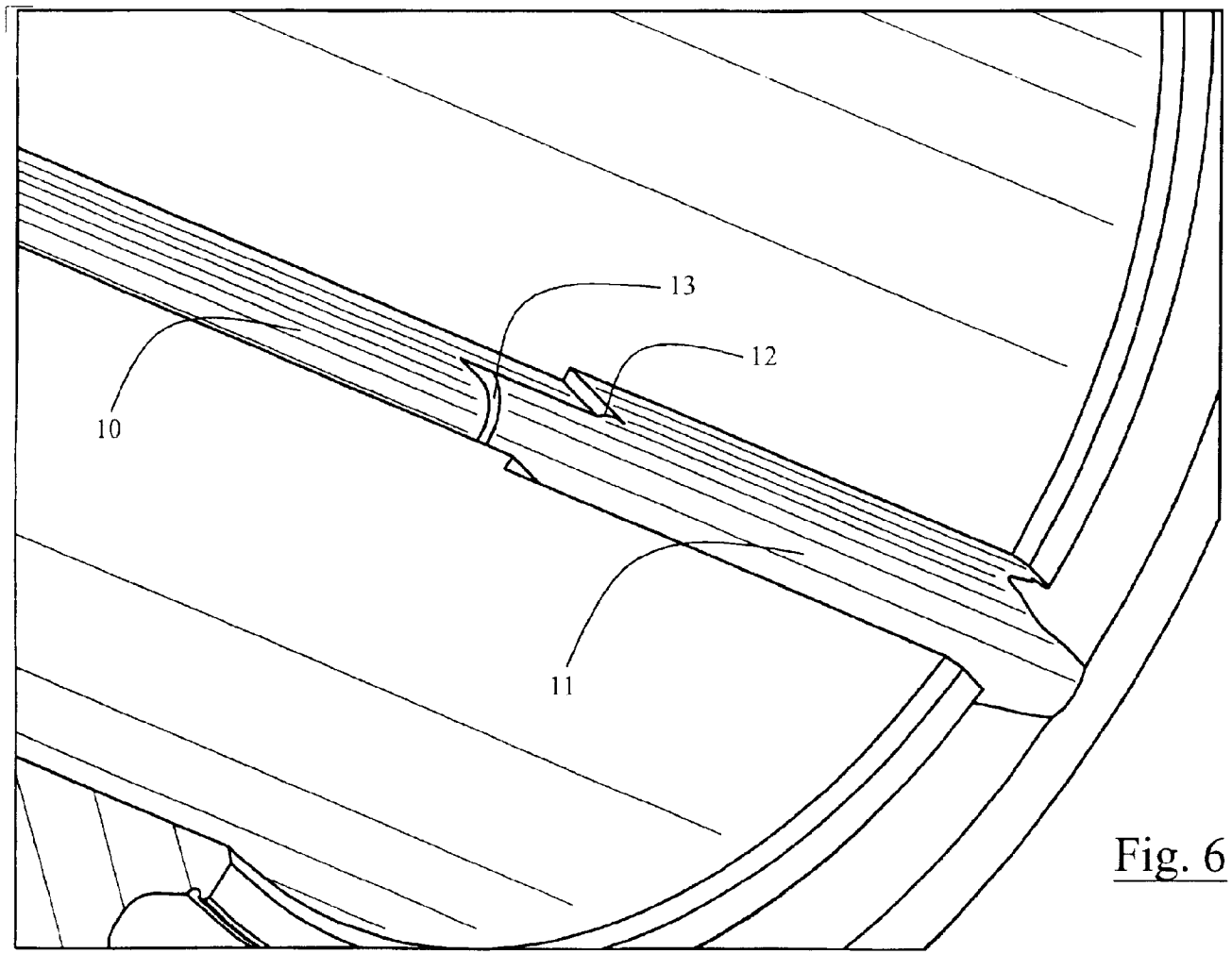
FIG. 6 is an enlarged cross-section of a pin end of a drill component further showing the created shoulder and undercut.

FIG. 6 is an enlarged cross-section of a pin end 21 of a drill component 20 depicting in greater detail the created shoulder 13 and undercut 12. The length of overlap between first slot 10 and second slot 11 is within the elastic deformation range of the conductive tube. The conductive tube 24 is stretched in order to install it within the drill component and the overlapping slot. However, it cannot be stretched beyond the point where plastic deformation occurs. This aspect of the invention and the installation process will be discussed in greater detail below.

Figure 7:
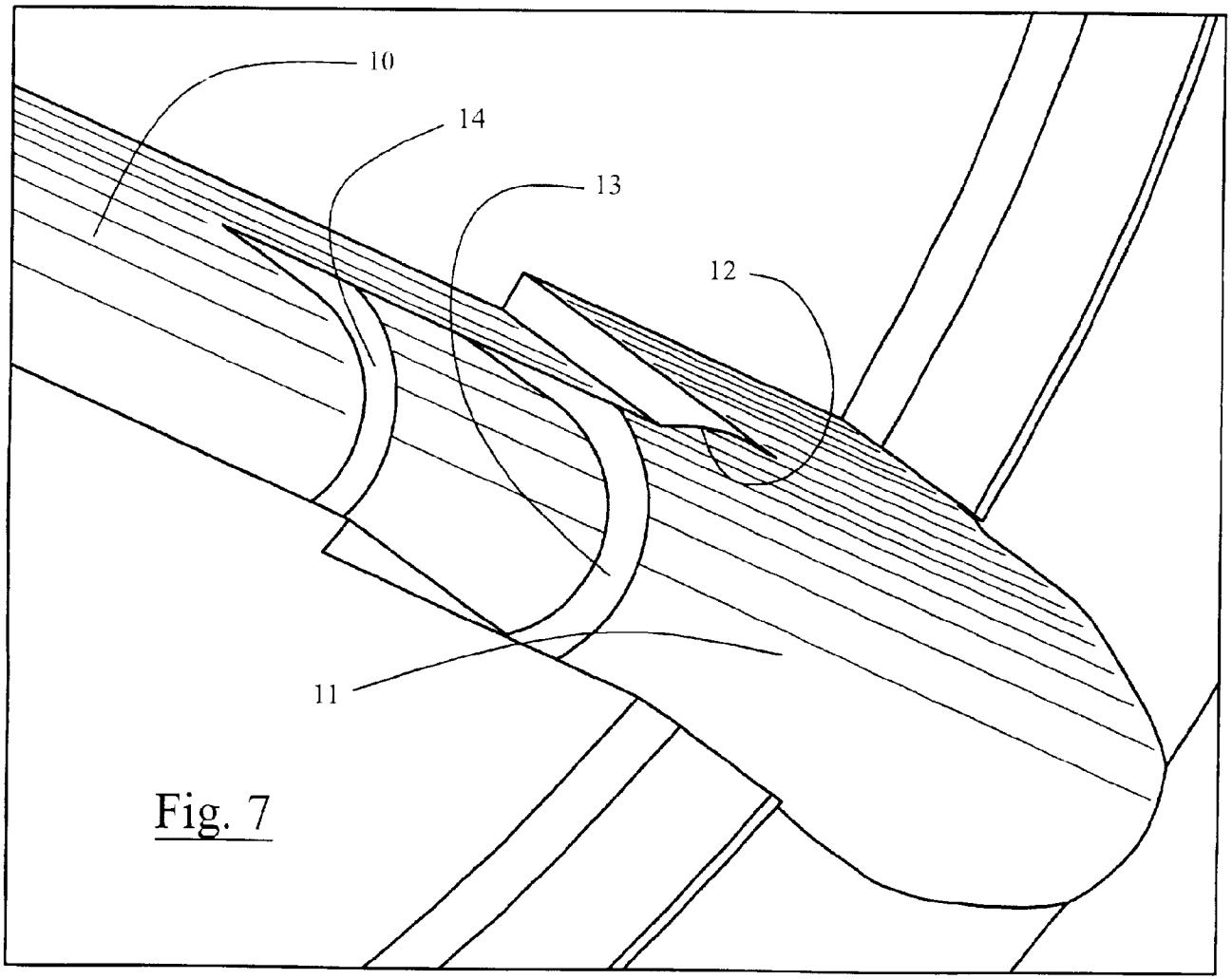
FIG. 7 is an enlarged cross-section of a pin end of a drill component showing multiple slots.

The distinctness of the overlapping slots and resulting undercuts and shoulders are best seen in FIG. 7 which is an enlarged cross-section of the pin end 21 as depicted in FIG. 1. The slot 10 has a smaller width than slot 11 as shown in FIG. 7. The slot 11 goes under slot 10 at the point of intersection causing an overlap of the slots. Additionally, an undercut 12 is formed which holds the conductive tube 24 in place to a specified depth The relative height of each slot could be modified by raising or lowering the undercut to a desired depth for the electrical transmission line to be placed at. The shoulder 13 holds the larger outer diameter 30 of conductive tube 24 in place. Another shoulder 14 depicts the possibility of more than one shoulder used to retain the conductive tube of an electrical transmission line or coaxial cable providing the conductive tube has a corresponding outer diameter.

In the above descriptions and drawings only the pin end 21 of pipe component 20 has explicitly shown the retention mechanism of overlapping slots. Naturally, the same depiction could be made with the box end 22 of drill component 20 showing substantially the same overlapping slots with resulting undercut 12 and shoulder 13.

A conductive tube 24 is placed within the slots 10 and 11. Preferably, the conductive tube 24 runs almost the entire length of the drill component 20, beginning in the pin end 21, at overlapping slots 10 and 11, passing through interior of the body or internal diameter 23 of the pipe component 20, continuing through the box end 22, and ending near the box end 22 in slots 10 and 11. The conductive tube 71 is preferably held in tension after it is inserted in the drill pipe 20 and remains in tension during downhole use. This prevents the conductive tube 71 from moving relative to the undercut 12 and shoulder 13 during downhole use. The conductive tube is preferably made of metal, more preferably a strong metal, most preferably steel. By "strong metal" it is meant that the metal is relatively resistant to deformation in its normal use state. The metal is preferably stainless steel, most preferably 316 or 316L stainless steel. A preferred supplier of stainless steel is Plymouth Tube, Salisbury, Md.

In a preferred embodiment of the invention, the conductive tube is held in place in each end by means of the overlapping slots 11 and 12. The conductive tube 24 has a first outer diameter 31 and a second outer diameter 30 as shown in FIG. 3. One end of the conductive tube 24 is placed in the overlapping slots 11 and 12 in drill component 20 by placing the larger outer diameter 30 in the larger slot 11. The conductive tube 24 is then pulled such that the outer diameter 31 and 30 slide under the undercut 12 and the outer diameter 13 rests in slot 10 and outer diameter 30 rests in slot 11. Subsequently the larger outer diameter 30 abuts against the shoulder 13; thus the conductive tube is held in place.

To complete the installation process in the opposite end of the drill component 20, be it pin end 21 or box end 22, the conductive tube 24 is stretched along the internal diameter 23 of drill component 20. As the conductive tube 24 is stretched it increases in tension. The conductive tube is stretched far enough so that the larger outer diameter 30 will fit in the larger slot 11. When this point is reached the conductive tube tension is relaxed causing the larger outer diameter 30 and smaller outer diameter 31 to slide under the undercut 12. The conductive tube 24 will stop sliding when the larger outer diameter 30 abuts against the shoulder 13. The conductive tube 24 should still be in tension so that each end of the conductive tube will remain place under the undercut 12 and abutting against the shoulder 13. It is therefore necessary that the length of stretch needed to place the larger diameter 30 in larger slot 11 while in tension does not exceed the elastic deformation range of the conductive tube. If during the installation process the elastic deformation range is exceeded, the conductive tube 24 will lose its ability to rebound back to a shorter length. Thus the tube will not be in tension and will not stay attached to the drill component 20. In a preferred embodiment, the conductive tube is in tension within the drill component. The preferred amount of tension is between 300 and 1200 pounds-force. In another embodiment, the conductive tube could be press fit into the smaller slot during the installation process described above.

In an alternative embodiment, the conductive tube may be insulated from the pipe in order to prevent possible galvanic corrosion. At present, the preferred material with which to insulate the conductive tube 71 is PEEK®.

Many types of data sources are important to management of a drilling operation. These include parameters such as hole temperature and pressure, salinity and pH of the drilling mud, magnetic declination and horizontal declination of the bottom-hole assembly, seismic look-ahead information about the surrounding formation, electrical resistivity of the formation, pore pressure of the formation, gamma ray characterization of the formation, and so forth. The high data rate provided by the present invention provides the opportunity for better use of this type of data and for the development of gathering and use of other types of data not presently available.

It is therefore intended that the foregoing detailed description be regarded as illustrative rather than limiting, and that it be understood that it is the following claims, including all equivalents, that are intended to define the spirit and scope of this invention.

What is claimed is:

1. An electrical transmission line retention mechanism in a pipe component having ends, comprising:

a first slot formed in the pipe component intermediate its ends and exposed at an internal diameter of the pipe component;

a second slot, wider than the first slot, formed in the pipe component and aligned with and overlapping the first slot; and the second slot also exposed at the internal diameter and terminating at one of the ends of the pipe component;

wherein the first and second slots also adapted to affix an electrical transmission line along the internal diameter of the pipe component.

2. A retention mechanism of claim 1 wherein the mechanism comprise more than two slots.

3. The retention mechanism of claim 2 wherein the more than two slots have increasing widths.

4. The retention mechanism of claim 1 wherein an undercut is formed by the first and second slots.

5. The retention mechanism of claim 1 wherein a shoulder is formed by the first and second slots.

6. The retention mechanism of claim 1 wherein the slot overlap is offset.

7. The retention mechanism of claim 1 wherein the end may be selected from the group consisting of a box end and a pin end.

8. The retention mechanism of claim 1 wherein the conductive tube is press-fit into the slots.

9. A system for mechanically retaining an electrical transmission line in a pipe component having ends, comprising:

a coaxial cable, the coaxial cable comprising a conductive tube and a conductive core within it, the conductive tube having a first and a second outer diameter, the second outer diameter being larger than the first outer diameter;

a first slot formed in the pipe component intermediate its ends and exposed at an internal diameter of the pipe component;

a second slot, wider than the first slot, formed in the pipe component and aligned with and overlapping the first slot;

the second slot also exposed at the internal diameter and terminating at one of the ends of the pipe component; and the conductive tube is disposed within the slits with the first and second slots forming complementary recesses with the first and second diameters of the conductive tube;

wherein the conductive tube is in electrical communication with the internal diameter of the pipe component.

10. The system of claim 9 wherein the conductive tube has an elasticity such that the conductive tube is in tension.

11. The system of claim 9 wherein the slot overlap length is within the elastic deformation range of the conductive tube.

12. The system of claim 9 wherein the system comprises more than two slots.

13. The system of claim 12 wherein the more than two slots have increasing widths.

14. The system of claim 9 wherein the end may be selected from the group consisting of a box end or a pin end.

15. The system in claim 9 wherein the conductive tube is press-fit into the slots.

16. A system for mechanically retaining an electrical transmission line for use in a rotary dull string, the drill string comprising individual drill components, each drill component containing the electrical transmission line, the system comprising;

a drill component with a substantially uniform internal diameter with a pin end and a box end;

a coaxial cable, the coaxial cable comprising a conductive tube and a conductive core within it, the conductive tube having a first and a second outer diameter, the second outer diameter being larger than the first outer diameter;

a first slot formed in the pipe component intermediate its ends and exposed at an internal diameter of the pipe component;

a second slot, wider than the first slot, formed in the pipe component and aligned with and overlapping the first slot;

the second slot also exposed at the internal diameter and terminating at one of the ends of the pipe component;

the first and second slot forming an undercut; and the conductive tube is disposed within the slots with the first and second slots forming complementary recesses with the first and second diameters of the conductive tube;

wherein the conductive tube is in electrical communication with the internal diameter of the drill component.

17. The system of claim 16 wherein the system comprises more than two slots.

18. The system of claim 16 wherein the more than two slots have increasing widths.

19. The system of claim 18 wherein the conductive tube has an elasticity such that the conductive tube is in tension.

20. The system of claim 16 wherein the slot overlap length is within the elastic deformation range of the conductive tube.

21. The system in claim 16 wherein the tube is tension between 300 and 1200 foot pound-force.

22. The system in claim 16 wherein the conductive tube is press-fit into the slots.

* * * * *